United States Patent [19]

Bruno

[11] 4,254,563

[45] Mar. 10, 1981

[54] FOOTWEAR AND METHOD OF MANUFACTURE THEREOF

[76] Inventor: Maria T. Bruno, 7243 S. Pebblecreek, West Bloomfield, Mich. 48033

[21] Appl. No.: 38,474

[22] Filed: May 14, 1979

[51] Int. Cl.[3] ..... A43B 1/02

[52] U.S. Cl. ..... 36/9 R; 36/112; 12/142 G

[58] Field of Search ..... 36/9 R, 10, 112, 90; 12/142 G; 2/61, 239

[56] References Cited

U.S. PATENT DOCUMENTS

| | | | |
|---|---|---|---|
| 1,284,788 | 11/1918 | Sawyer | 36/9 R |
| 1,458,717 | 6/1923 | Lochwitzky | 36/9 R |
| 2,415,004 | 1/1947 | Feldhake | 36/112 X |
| 2,598,218 | 5/1952 | Brumby | 36/112 |
| 2,919,503 | 1/1960 | Sholovitz | 36/9 R |
| 3,024,543 | 3/1962 | Klym | 36/9 R |

FOREIGN PATENT DOCUMENTS

| | | | |
|---|---|---|---|
| 499063 | 2/1951 | Belgium | 36/9 R |
| 1220653 | 1/1960 | France | 36/9 R |

*Primary Examiner*—James Kee Chi

*Attorney, Agent, or Firm*—Whittemore, Hulbert & Belknap

[57] ABSTRACT

Footwear comprising cloth inner sole, back and front members constructed of three separate layers of jean material quilted together and frayed at their edges. The back and front members are sewn to the inner sole about the periphery of the inner sole and a rubber outer sole is sewn to the inner sole about the periphery thereof. A three layer, jean material, tie extends completely around the top of the back member of the footwear and beyond the front end thereof for securing the footwear to a human ankle. In manufacture of the footwear, the back is sewn to the inner sole at the back of the inner sole initially and then toward the front of the inner sole on both sides thereof to within a short distance of both ends of the back member, the front member is completely sewn to the front of the inner sole around the periphery thereof, after which the sewing of the back member to the inner sole is completed. The tie is folded over the upper edge of the back member and sewn thereto in the folded condition to provide six layers of tie material for reinforcing the top edge of the back member.

4 Claims, 8 Drawing Figures

FIG. 1
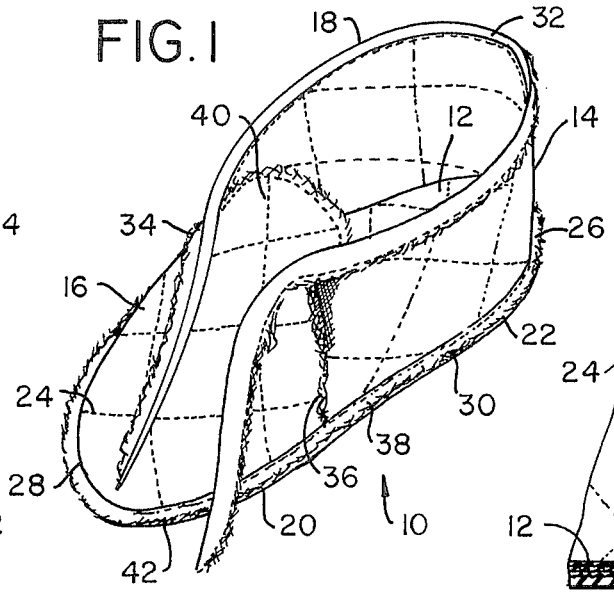
FIG. 7
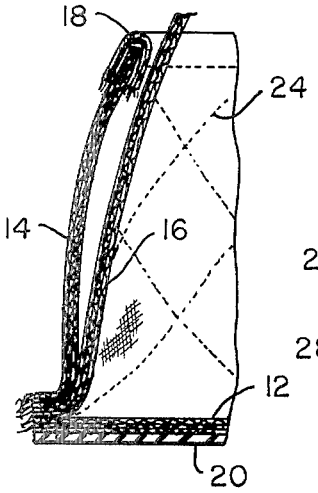
FIG. 8
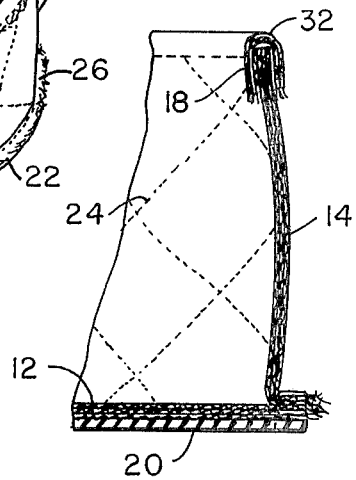
FIG. 3
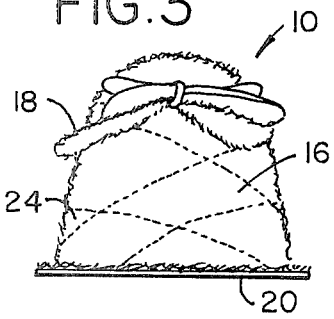
FIG. 2
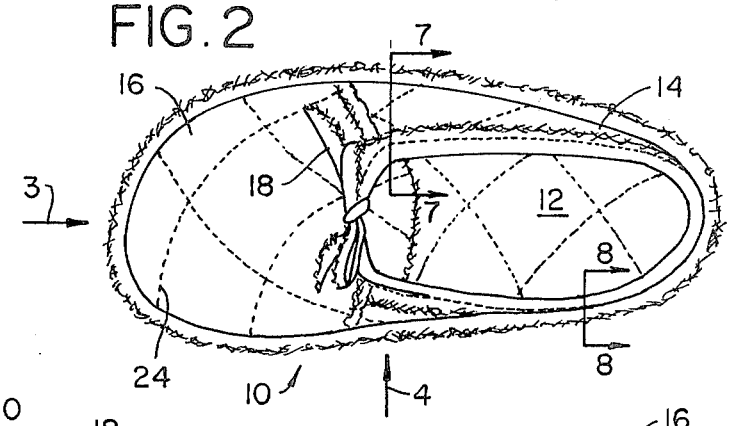
FIG. 4
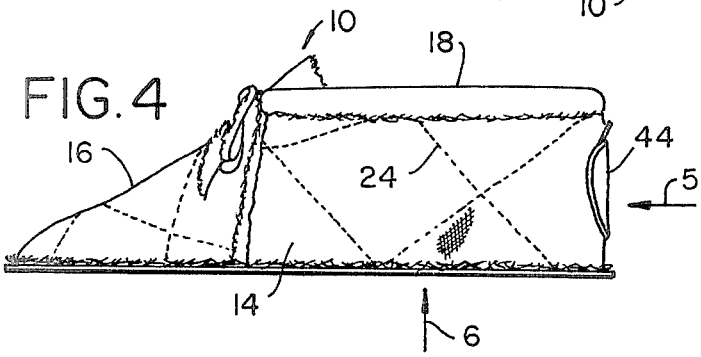
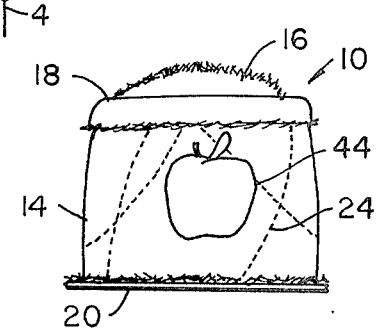
FIG. 5
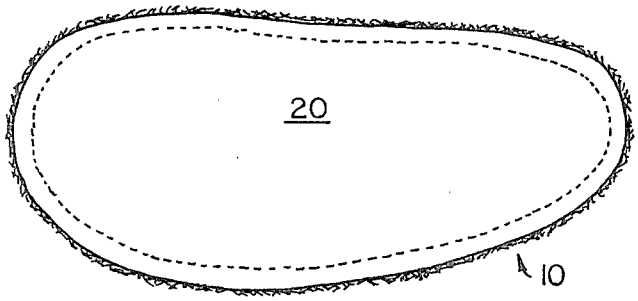
FIG. 6

FOOTWEAR AND METHOD OF MANUFACTURE THEREOF

BACKGROUND OF THE INVENTION

1. Field of the Invention

The invention relates to footwear and refers more specifically to a leisure type slipper constructed of quilted jean material having frayed edges forming the inner sole, back, front and tie of the footwear and a rubber outer sole sewn to the bottom of the inner sole. The tie extends completely around the top of the back member of the footwear and beyond the ends thereof toward the front of the inner sole to facilitate tying of the footwear to a human ankle.

2. Description of the Prior Art

Footwear in the past, even footwear for leisure activities, has often been stiff and uncomfortable. Also, such footwear has in the past been constructed in such a manner as to make the footwear unsuited to many leisure activities. Footwear of the past has been constructed of a number of materials such as leather, plastic, and even wood. Often, with the footwear of the past, the human foot has been required to conform to the contours of the footwear rather than the footwear conforming to the contours of human feet. Further, such materials have made the cost of such prior footwear unnecessarily high.

SUMMARY OF THE INVENTION

In accordance with the invention, footwear is provided comprising an inner sole, back and front members constructed of a plurality of layers of quilted jean material which is fringed around the edges, an outer sole of wear-resistant rubber, and a tie secured around the top of the back for securing the footwear to a human ankle.

In the manufacture of the footwear of the invention, the back member is secured to the inner sole by first sewing the center of the back member to the back of the inner sole and then proceeding to sew the bottom of the back member to the periphery of the inner sole at both sides thereof from the back toward the front of the inner sole to a short distance from the front ends of the back member. The front member of the footwear of the invention is then sewn to the inner sole about the periphery thereof from the front toward the back of the footwear, followed by completing sewing of the back member to the inner sole over the front member centrally of the periphery of the inner sole. The outer sole is sewn to the footwear about the periphery of the inner sole. The tie member is folded over the top of the back member and sewn thereto and extends a substantial distance beyond the front ends of the back member and provides six separate layers of jean material for reinforcing the top of the back member.

BRIEF DESCRIPTION OF THE DRAWINGS

FIG. 1 is a perspective view of the footwear of the invention with the tie, untied.

FIG. 2 is a top view of the footwear of the invention, with the tie, tied.

FIG. 3 is a front view of the footwear of the invention, taken substantially in the direction of arrow 3 in FIG. 2.

FIG. 4 is a side view of the footwear of the invention, taken substantially in the direction of arrow 4 in FIG. 2.

FIG. 5 is a back view of the footwear of the invention, taken substantially in the direction of arrow 5 in FIG. 4.

FIG. 6 is a bottom view of the footwear of the invention, taken substantially in the direction of arrow 6 in FIG. 4.

FIG. 7 is a partial section view of the footwear of the invention, taken substantially on the line 7—7 in FIG. 2.

FIG. 8 is another partial section view of the footwear of the invention, taken substantially on the line 8—8 in FIG. 2.

DESCRIPTION OF THE PREFERRED EMBODIMENT

As shown best in FIG. 1, the footwear 10 includes an inner sole 12, a back member 14, a front member 16, a tie 18 and an outer sole 20.

Each of the inner sole 12, back member 14 and front member 16 are constructed of three separate layers of jean material, which may be used jean material. The jean material of the members 12, 14 and 16 is frayed around the edges thereof to provide fringes 22 on the finished footwear 10. The jean material in each of the inner sole 12, back member 14 and front member 16 are quilted together as shown at 24.

The inner sole 12 is cut in the outline of a human foot and has a back 26 and front 28.

The back member 14, as shown, is adapted to fit around a human heel and has a bottom 30, a top 32 and front ends 34 and 36. A portion of the bottom 30 of the back member is turned outwardly to form flange 38 to facilitate sewing of the back member 14 to the inner sole 12 about the periphery thereof, as will be considered subsequently.

The front member 16, as shown, is adapted to fit over the front of a human foot and provides a tongue portion 40 for the footwear 10, as shown best in FIG. 1. The front member 16 also includes an outwardly extending flange 42 around the bottom thereof to facilitate sewing of the front member 16 to the inner sole 12.

The tie 18, again as shown best in FIG. 1, is also constructed of three separate layers of jean material sewn together. The tie 18 is folded over the top 32 of the back member 14 of the footwear 10 and is sewn thereto in the folded condition as shown best in FIG. 7 to provide six separate layers of jean material, reinforcing the top of the back member 14 of the footwear 10.

The ends of the tie 18, as shown, extend toward the front of the footwear 10 beyond the front ends 34 and 36 of the back member 14 to facilitate tying the footwear 10 to a human ankle. It will be noted that the edges of the tie are also frayed to complete the fringe motif of the footwear 10.

The outer sole 20 may be cut from rubber, such as an old inner tube or the like, and sewn to the inner sole 12 and the back member 14 and front member 16 about the periphery of the inner sole through the edge of the inner sole and the flanges 38 and 42 on the back member 14 and front member 16, respectively.

In making the footwear 10, the inner sole 12, back member 14 and front member 16 are first cut from jean material in three separate layers and then quilted together, and the edges of the inner sole, back and front members are frayed, as shown.

The back member 14 is then sewn to the inner sole 12, starting from the back 26 of the inner sole 12 and proceeding toward the ends 34 and 36 of the back member 14 on both sides of the inner sole 12. The back member 14 is thus sewn to the inner sole 12 to within a short distance, as for example, an inch or two, from the ends 34 and 36 thereof. The front member 16 is then sewn to the inner sole 12, again about the periphery of the front thereof, after which the sewing of the back member 14 to the inner sole 12 is completed over the flange 42 of the front member 16.

The tie 18 is cut, frayed, sewn together and folded over the top of the back member and sewn to the top of the back member in the folded condition, as shown in FIG. 7. As indicated previously, the tie extends at both ends beyond the front of the back member and is fringed as are the other cloth portions of the footwear 10.

The outer sole is cut and sewn to the inner sole around the periphery thereof and through the flange portions of the back member 14 and front member 16.

An ornamental design 44, as shown best in FIG. 5, may be sewn to the footwear 10, as desired, to enhance the appearance thereof and/or for trademark purposes to complete the manufacture of the footwear 10.

While one embodiment of the invention has been disclosed, other embodiments and modifications thereof are contemplated. It is the intention to include all such embodiments and modifications as are suggested by the foregoing disclosure within the scope of the invention as defined by the appended claims.

What I claim as my invention is:

1. Footwear comprising an inner sole in the outline of a human foot, a back member adapted to fit around a human heel and extending from the back approximately halfway to the front of the footwear having a flange portion about the bottom thereof extending outwardly toward the edge of the back part of the inner sole and having a top, a front member adapted to extend over the front portion of a human foot having a flange portion around the bottom thereof extending outwardly toward the edge of the front part of the inner sole of the footwear, each of said inner sole, back member and front member being constructed of three separate layers of jean material which are quilted together, a tie constructed of three separate layers of jean material folded over both sides of the top of the back member and extending outwardly of the front of the back member to provide ties for securing the footwear to a human ankle sewn to the top edge of the back member to provide six thicknesses of jean material in the tie member around the top of the back member and a rubber outer sole on the bottom of the inner sole sewn to the inner sole, back member and front member around the outer periphery of the inner sole and through the flange portions of the back member and front member of the footwear, said jean material being frayed at all edges thereof to provide fringes on the footwear at all edges of the jean material.

2. The method of making footwear comprising cutting an inner sole of three separate layers of jean material, quilting the three separate layers of the jean material together to form a single inner sole in the outline of a human foot, cutting a back member of three separate layers of jean material in a configuration to wrap around a human heel, quilting the three separate layers of jean material into a single back member, sewing the bottom of the back member to the inner sole around the outer periphery of the back of the inner sole, cutting a front member from three separate layers of jean material, quilting the three separate layers of jean material into a single front member, sewing the bottom of the front member to the front of the inner sole around the outer periphery of the front of the inner sole, cutting a wear-resistant outer sole of rubber in the form of a human foot and sewing it to the bottom of the inner sole and to the bottom of the back member and the bottom of the front member around the periphery of the inner sole, cutting a tie from three pieces of jean material, folding the tie over the top of the back member and sewing the tie to the top of the back member with the tie in the folded condition whereby the top of the back member of the footwear is reinforced by six separate layers of jean material and with the ends thereof extending outwardly of the front of the back member and fraying all of the edges of the jean material to provide a fringe at the edges of the jean material in the finished footwear.

3. The method as set forth in claim 2 wherein the back member is sewn to the inner sole first at the back of the inner sole and then toward the front of the inner sole in both directions from the back of the inner sole.

4. The method as set forth in claim 3 wherein the back member is sewn to the inner sole to within a short distance of both ends thereof, the front member is then completely sewn to the inner sole, followed by completing sewing of the back member to the inner sole over the front member.

* * * * *